US009534461B2

(12) United States Patent
Xu et al.

(10) Patent No.: US 9,534,461 B2
(45) Date of Patent: Jan. 3, 2017

(54) CONTROLLER FOR DOWNHOLE TOOL

(71) Applicant: Weatherford Technology Holdings, LLC, Houston, TX (US)

(72) Inventors: Wei Jake Xu, Houston, TX (US); Albert C. Odell, II, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 267 days.

(21) Appl. No.: 14/207,266

(22) Filed: Mar. 12, 2014

(65) Prior Publication Data

US 2014/0262211 A1 Sep. 18, 2014

Related U.S. Application Data

(60) Provisional application No. 61/794,177, filed on Mar. 15, 2013.

(51) Int. Cl.

| | |
|---|---|
| ***E21B 34/14*** | (2006.01) |
| ***E21B 23/00*** | (2006.01) |
| ***E21B 23/04*** | (2006.01) |
| ***E21B 10/32*** | (2006.01) |

(52) U.S. Cl.

CPC ..... *E21B 23/006* (2013.01); *E21B 10/322* (2013.01); *E21B 23/04* (2013.01)

(58) Field of Classification Search

CPC ..... E21B 23/006; E21B 10/322; E21B 34/14; E21B 10/32; E21B 34/102

See application file for complete search history.

(56) References Cited

U.S. PATENT DOCUMENTS

| | | | |
|---|---|---|---|
| 6,289,999 | B1 | 9/2001 | Dewey et al. |
| 7,401,666 | B2 | 7/2008 | Fanuel et al. |
| 7,416,029 | B2 | 8/2008 | Telfer et al. |
| 7,891,441 | B2 | 2/2011 | Lee |

(Continued)

FOREIGN PATENT DOCUMENTS

| | | | |
|---|---|---|---|
| GB | 2432376 | A | 5/2007 |
| WO | 2007/017651 | A1 | 2/2007 |
| WO | 2011/041562 | A2 | 4/2011 |

OTHER PUBLICATIONS

PCT International Search Report and Written Opinion dated Jan. 28, 2015, for International Application No. PCT/US2014/026280.

(Continued)

*Primary Examiner* — Kipp Wallace

(74) *Attorney, Agent, or Firm* — Patterson & Sheridan, L.L.P.

(57) ABSTRACT

A controller for operating a downhole tool includes a tubular body; a seat disposed in the body for receiving first and second pump-down plugs, at least a portion of one of the seat and the plugs being radially displaceable to pass through or allow passage of the other at a first threshold pressure differential; a catcher located below the seat for receiving the plugs after passing through the seat; a toggle linked to the seat to alternate between a locked position and an unlocked position in response to seating of the plugs; and a control mandrel for engaging a piston of the downhole tool and linked to the toggle: to be longitudinally movable between a first position and a second position when the toggle is unlocked, and to be prevented from movement from the first position to the second position when the toggle is locked.

7 Claims, 12 Drawing Sheets

(56) References Cited

U.S. PATENT DOCUMENTS

| | | | | |
|---|---|---|---|---|
| 8,657,039 | B2 | 2/2014 | Radford et al. | |
| 2006/0207797 | A1 | 9/2006 | Dewey et al. | |
| 2007/0107944 | A1* | 5/2007 | Lee | E21B 17/1014 175/317 |
| 2010/0089583 | A1* | 4/2010 | Xu | E21B 10/322 166/298 |
| 2010/0096191 | A1 | 4/2010 | Lassoie et al. | |
| 2011/0284233 | A1* | 11/2011 | Wu | E21B 10/32 166/321 |
| 2011/0315389 | A1 | 12/2011 | Crider et al. | |
| 2012/0055714 | A1* | 3/2012 | Adam | E21B 41/00 175/57 |
| 2012/0227973 | A1* | 9/2012 | Hart | E21B 21/103 166/329 |
| 2013/0025868 | A1 | 1/2013 | Smith et al. | |

OTHER PUBLICATIONS

Canadian Office Action dated Jun. 21, 2016, for Canadian Patent Application No. 2,903,701.

* cited by examiner

CONTROLLER FOR DOWNHOLE TOOL

BACKGROUND OF THE DISCLOSURE

Field of the Disclosure

The present disclosure generally relates to a controller for a downhole tool.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

As more casing/liner strings are set in the wellbore, the casing/liner strings become progressively smaller in diameter to fit within the previous casing/liner string. In a drilling operation, the drill bit for drilling to the next predetermined depth must thus become progressively smaller as the diameter of each casing/liner string decreases. Therefore, multiple drill bits of different sizes are ordinarily necessary for drilling operations. As successively smaller diameter casing/liner strings are installed, the flow area for the production of oil and gas is reduced. Therefore, to increase the annulus for the cementing operation, and to increase the production flow area, it is often desirable to enlarge the borehole below the terminal end of the previously cased/lined borehole. By enlarging the borehole, a larger annulus is provided for subsequently installing and cementing a larger casing/liner string than would have been possible otherwise and the bottom of the formation can be reached with comparatively larger diameter casing/liner, thereby providing more flow area for the production of oil and/or gas.

In order to accomplish drilling a wellbore larger than the bore of the casing/liner, a drill string with an underreamer and pilot bit may be employed. Underreamers may include a plurality of arms which may move between a retracted position and an extended position. The underreamer may be passed through the casing/liner, behind the pilot bit when the arms are retracted. After passing through the casing, the arms may be extended in order to enlarge the wellbore below the casing. Underreamers also lessen the equivalent circulation density (ECD) while drilling the borehole.

SUMMARY OF THE DISCLOSURE

The present disclosure generally relates to a controller for a downhole tool. In one embodiment, a controller for operating a downhole tool includes a tubular body; a seat disposed in the body for receiving first and second pump-down plugs, at least a portion of one of the seat and the plugs being radially displaceable to pass through or allow passage of the other of the seat and the plugs at a first threshold pressure differential; a catcher located below the seat for receiving the plugs after passing through the seat; a toggle linked to the seat to alternate between a locked position and an unlocked position in response to seating of the plugs; and a control mandrel for engaging a piston of the downhole tool and linked to the toggle: to be longitudinally movable between a first position and a second position when the toggle is unlocked, and to be prevented from movement from the first position to the second position when the toggle is locked.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 11A illustrates a third controller for use with the BHA in a locked mode, according to another embodiment of the present disclosure.

FIGS. 11B-12B illustrate shifting of the third controller between modes.

DETAILED DESCRIPTION

Figure 1:
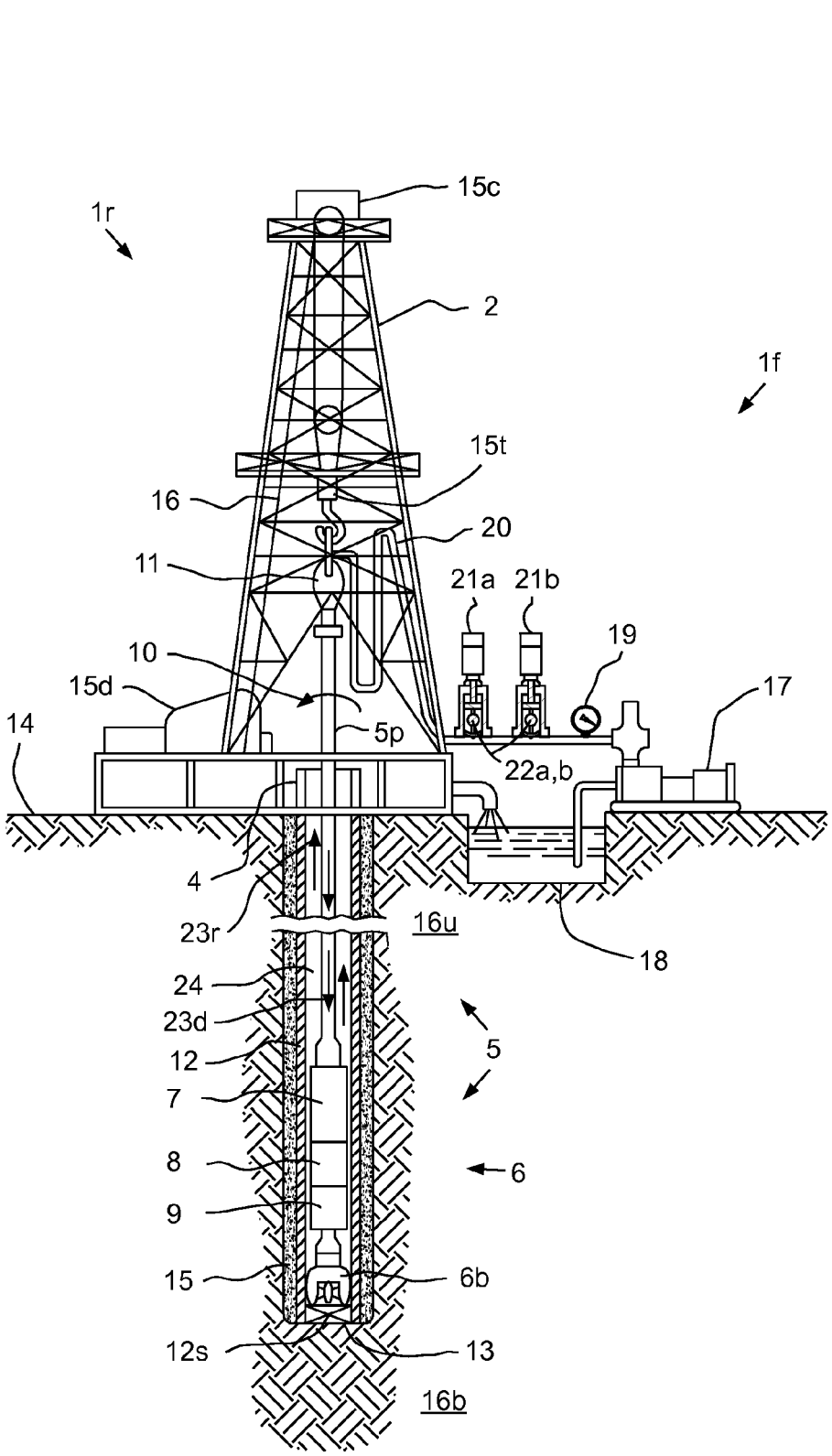
FIG. 1 illustrates a drilling system in a pilot mode, according to one embodiment of the present disclosure.

FIG. 1 illustrates a drilling system 1 in a pilot mode, according to one embodiment of the present disclosure. The drilling system 1 may include a drilling rig 1*r*, a fluid handling system 1*f*, and a pressure control assembly (PCA) (not shown). The drilling rig 1*r* may include a derrick 2 having a rig floor 3 at its lower end having an opening (not shown) through which a drill string 5 extends downwardly into the PCA. The PCA may be connected to a wellhead 4. The drill string 5 may include a bottomhole assembly (BHA) 6 and joints of drill pipe 5*p* connected together, such as by threaded couplings. The BHA 6 may be connected to the drill pipe 5*p*, such as by a threaded connection. The BHA 6 may include a pilot drill bit 6*b*, one or more drill collars (not shown), a controller 7, an underreamer 8, and a catcher 9. The pilot bit 6*b* and underreamer 8 may be rotated 10 by a top drive 11 via the drill pipe 5*p* and/or the BHA 6 may further include a drilling motor (not shown) for rotating the pilot bit. The BHA 6 may further include an instrumentation sub (not shown), such as a measurement while drilling (MWD) and/or a logging while drilling (LWD) sub.

The wellhead 4 may be mounted on a casing string 12 which has been deployed into a wellbore 13 drilled from a surface 14 of the earth and cemented 15 into the wellbore. An upper end of the drill string 5 may be connected to a quill of the top drive 11. The top drive 11 may include a motor for rotating 10 the drill string 5. The top drive motor may be electric or hydraulic. A frame of the top drive 11 may be coupled to a rail (not shown) of the derrick 2 for preventing rotation of the top drive housing during rotation of the drill string 5 and allowing for vertical movement of the top drive with a traveling block 15*t*. A frame of the top drive 13 may be suspended from the derrick 2 by the traveling block 15. The traveling block 15*t* may be supported by wire rope 16 connected at its upper end to a crown block 15*c*. The wire rope 16 may be woven through sheaves of the blocks 15*c,t* and extend to drawworks 15*d* for reeling thereof, thereby raising or lowering the traveling block relative to the derrick 2.

Alternatively, the wellbore may be subsea having a wellhead located adjacent to the waterline and the drilling rig may be a located on a platform adjacent the wellhead. Alternatively, the wellbore may be subsea having a wellhead located adjacent to the seafloor and the drilling rig may be located on an offshore drilling unit. Alternatively, a Kelly and rotary table (not shown) may be used instead of the top drive.

The PCA may include a blow out preventer (BOP). A housing of the BOP may be connected to the wellhead 4, such as by a flanged connection. Alternatively, the PCA may further include a rotating control device (RCD), a variable choke valve, a pressure sensor, and a hydraulic power unit (HPU). The RCD may include a stripper seal and the housing. The stripper seal may be supported for rotation relative to the housing by bearings. The stripper seal-housing interface may be isolated by seals. The stripper seal may form an interference fit with an outer surface of the drill string 5 and be directional for augmentation by wellbore pressure. The choke may be connected to an outlet of the RCD. The choke may include a hydraulic actuator operated by a programmable logic controller (PLC) via the HPU to maintain backpressure in the wellhead 4.

The casing string 12 may extend to a depth adjacent a bottom of an upper formation 16*u*. The upper formation 16*u* may be non-productive and a lower formation 16*b* may be a hydrocarbon-bearing reservoir, environmentally sensitive, such as an aquifer, unstable, and/or non-productive.

The fluid system if may include a mud pump 17, a drilling fluid reservoir, such as a pit 18 or tank, a solids separator (not shown), such as a shale shaker, a pressure gauge 19, a supply line 20, and one or more launchers 21*a,b*. A lower end of the supply line 20 may be connected to an outlet of the mud pump 17 and an upper end of the supply line may be connected to an inlet of the top drive 11. The pressure gauge 19 may be connected to the supply line 20 and may be operable to monitor standpipe pressure.

Each launcher 21*a,b* may include a housing, a plunger, and an actuator. A pump-down plug, such as a ball 22*a,b*, may be disposed in the respective plunger for selective release and pumping downhole for operation of the controller 7. Each ball 22*a,b* may be made from a resilient material, such as a polymer. The ball polymer may be an engineering thermoplastic, an elastomer, or a copolymer such that each ball 22*a,b* may land on a seat 66 (FIG. 2A) of the controller 7 and sealingly engage the seat until a threshold squeeze pressure is exerted on the ball. Each ball 22*a,b* may then elastically deform and pass through the seat 66 in response to the squeeze pressure exerted thereon. The mud pump 17 may be used to pump each ball to the seat 66.

Alternatively, the seat 66 may be radially displaceable instead of the ball being deformable. The seat 66 may be radially displaceable by being made from a C-ring or resilient material or the seat may be segmented, such as being made from dogs or a collet. Alternatively, a launch pump may be used to pump each ball 22*a,b* to the seat and then the mud pump may be used to deform each ball through the seat.

Alternatively, the launchers 21*a,b* may be omitted and the balls 22*a,b* may be deployed by disconnecting a drill pipe connection and manually inserting the balls into a top of the drill pipe 5*p*.

To extend the wellbore 13 from a shoe 12*s* of the casing 12 into the lower formation 16*b*, the mud pump 17 may pump the drilling fluid 23*d* from the pit 18, through the supply line 20 to the top drive 11. The drilling fluid 23*d* may include a base liquid. The base liquid may be refined oil, water, brine, or a water/oil emulsion. The drilling fluid 23*d* may further include solids dissolved or suspended in the base liquid, such as organophilic clay, lignite, and/or asphalt, thereby forming a mud.

The drilling fluid 23*d* may flow from the supply line 20 and into the drill string 5 via the top drive 11. The drilling fluid 23*d* may be pumped down through the drill string 5 and exit the pilot bit 6*b*, where the fluid may circulate the cuttings away from the bit and return the cuttings up an annulus 24 formed between an inner surface of the casing 12 or wellbore 13 and an outer surface of the drill string 5. The returns 23*r* (drilling fluid plus cuttings) may flow up the annulus 24 to the wellhead 4. The returns 23*r* may then flow into the shale shaker and be processed thereby to remove the cuttings, thereby completing a cycle. As the drilling fluid 23*d* and returns 23*r* circulate, the drill string 5 may be rotated 10 by the top drive 11 and lowered by the traveling block 15, thereby extending the wellbore 13 through the shoe 12*s* into the lower formation 16*b*.

Alternatively, the BHA may further include the drilling motor, the MWD tool, and a steering tool, such as a bent sub or adjustable stabilizer, thereby imparting directional capability. If the directional BHA includes a bent sub, the BHA may be operated in a rotary mode or a sliding mode. To operate in the sliding mode, the drill pipe may be held rotationally stationary and inclination of the pilot bit by the bent sub may cause drilling along a curved trajectory. To operate in the rotary mode, the drill string may be rotated by the top drive to negate the curvature effect of the bent sub (aka corkscrew path) and the drilling trajectory may be straight. If the directional BHA includes the adjustable stabilizer, steering instructions may be transmitted to the stabilizer from the rig to adjust trajectory. To facilitate steering, the MWD sub may include sensors, such as accelerometers and magnetometers, for calculation of navigation parameters, such as azimuth, inclination, and/or tool face angle. The MWD sub may transmit the navigation parameters to the rig iteratively and in real time during drilling.

Alternatively, the fluid system may further include a supply flow meter, such as a volumetric flow meter, and a return flow meter, such as a mass flow meter. The PLC may receive a density of the drilling fluid from a mud blender (not shown) to calculate a supply mass flow rate. During the drilling operation, the PLC may perform a mass balance to ensure control of the lower formation. As the drilling fluid is being pumped into the wellbore by the mud pump and the returns are being received from the wellhead 4, the PLC may compare the mass flow rates (i.e., drilling fluid flow rate minus returns flow rate) using the respective flow meters. The PLC may use the mass balance to monitor for formation fluid (not shown) entering the annulus and contaminating the returns or returns entering the lower formation. Upon detection of a kick or lost circulation, the PLC may take remedial action by adjusting the choke accordingly, such as tightening the choke in response to a kick and loosening the choke in response to loss of the returns.

Figures 2A, 2B, 2C:
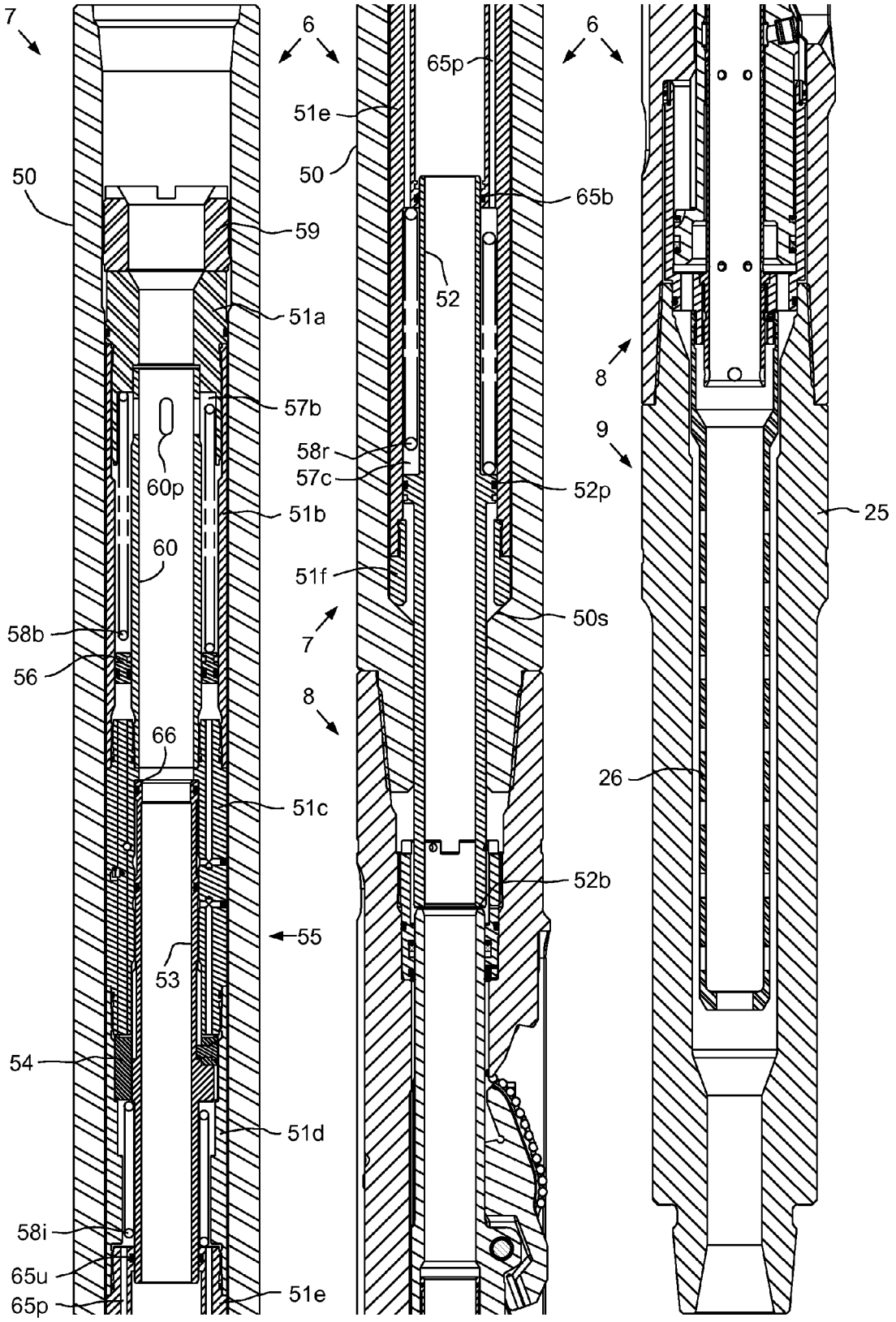
FIGS. 2A-2C illustrate a portion of a bottomhole assembly (BHA) of the drilling system.

FIGS. 2A-2C illustrate a portion of the BHA 6. The catcher 9 may receive two or more balls 22*a,b*, so that the underreamer 8 may be actuated a plurality of times during a single trip of the drill string 5. The catcher 9 may include a tubular housing 25 and a tubular cage 26. The housing 25 may have couplings formed at each longitudinal end thereof for connection with other components of the drill string 5. The couplings may be threaded, such as a box and a pin. The housing 25 may have a longitudinal bore formed therethrough for conducting drilling fluid 23*d*.

Figures 7A, 7B, 7C, 7D:
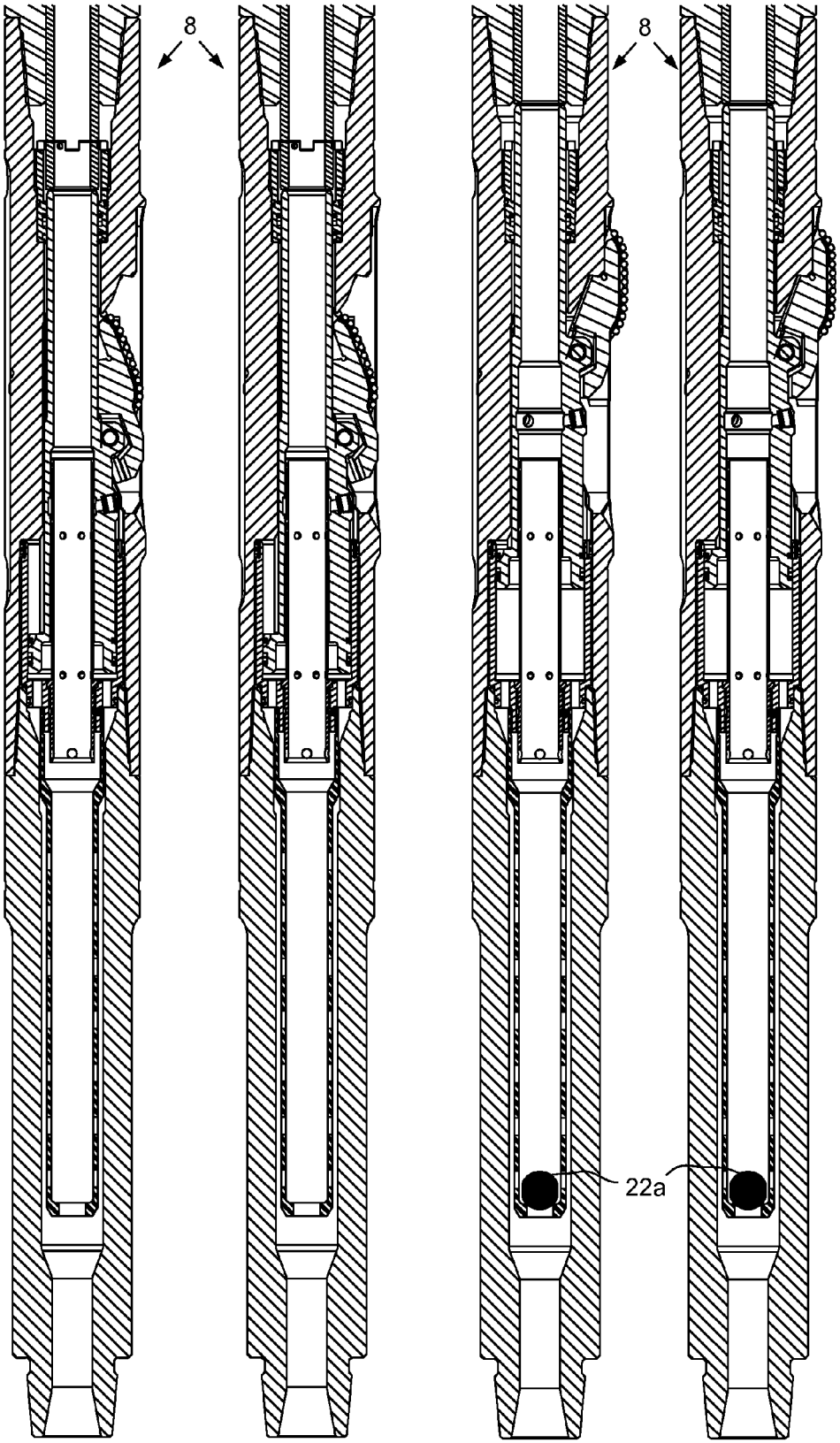
FIGS. 7A-7D illustrate shifting of the underreamer between modes.

The cage 26 may be disposed within the housing 25. The cage 26 may have a coupling formed at an upper longitudinal end thereof for connection to a lower seal sleeve 30*b* of the underreamer 8. The coupling may be threaded, such as a box. The cage 26 may be made from an erosion resistant material, such as a tool steel or cermet, or be made from a metal or alloy and treated, such as a case hardened, to resist erosion. The cage 26 may have a stop formed at a lower longitudinal end thereof for trapping the first ball 22*a* (FIG. 7C). The cage 26 may have a perforated tubular body having a longitudinal bore formed therethrough. A set of slots may be formed through a wall of the cage body and spaced therearound and slot sets may be spaced along the body. A port having a diameter less than or substantially less than a diameter of each ball 22*a,b* may be formed through the stop. An outer annulus may be formed between the cage body and the housing 25 and an inner annulus may be formed between the trapped balls 22*a* and the cage body. The annuli may serve as a fluid bypass for the flow of drilling fluid 23*d* through the catcher 9. The first caught ball 22*a* may land on the stop. Drilling fluid 23*d* may enter the inner annulus from the lower seal sleeve 30*b*, flow through the cage slots to the outer annulus, and flow down the outer annulus to bypass the caught balls.

Figure 3A:
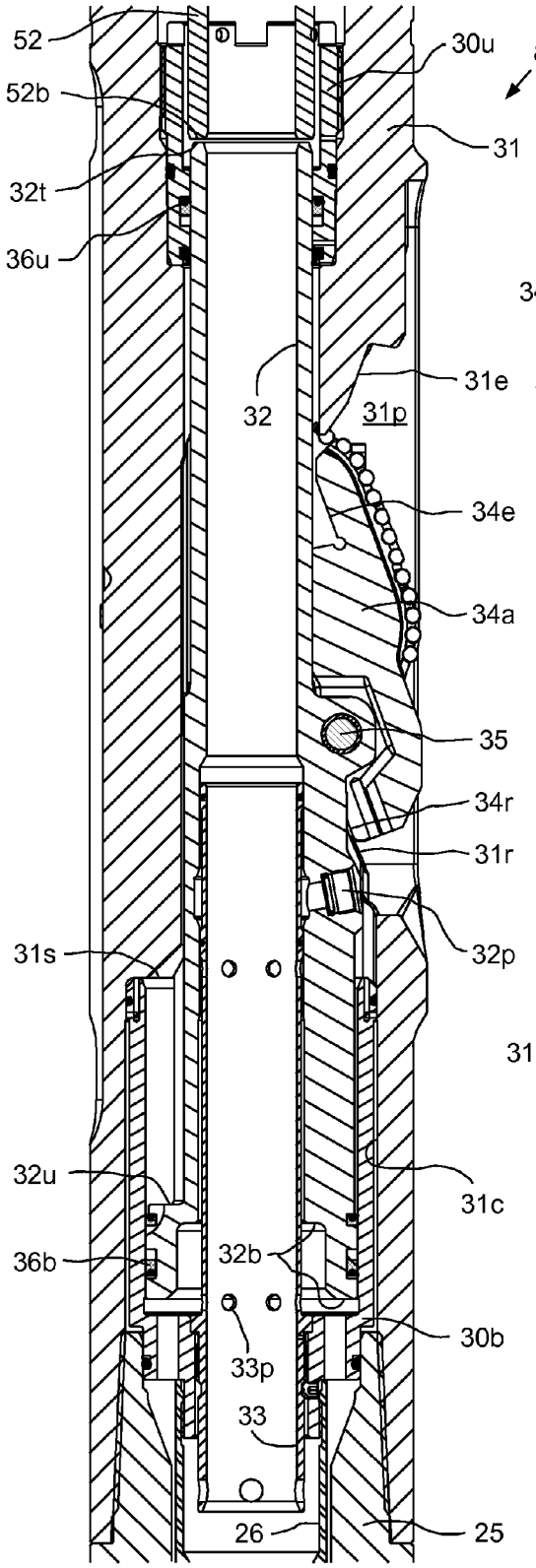
FIG. 3A illustrates an underreamer of the BHA in a retracted position.
Figure 3B:
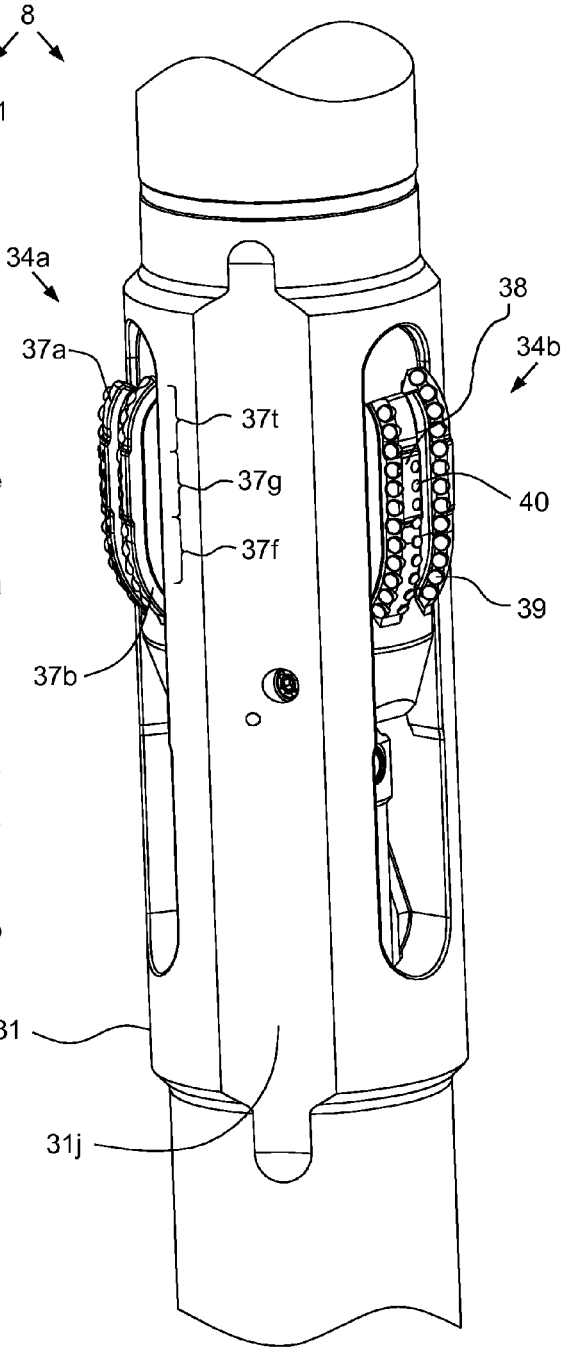
FIG. 3B illustrates the underreamer in an extended position.

FIG. 3A illustrates the underreamer 8 in a retracted position. FIG. 3B illustrates the underreamer 8 in an extended position. The underreamer 8 may include a body 31, a piston 32, one or more seal sleeves 30*u,b*, a flow sleeve 33, and one or more arms 34*a,b*. The body 31 may be tubular and have a longitudinal bore formed therethrough. Each longitudinal end of the body 31 may be threaded for longitudinal and torsional coupling to other drill string members, such as the controller 7 at an upper end thereof and the catcher housing 25 at a lower end thereof. The body 31 may have a pocket 31*p* formed through a wall thereof for each arm 34*a,b*. The body 31 may also have a chamber 31*c* formed therein at least partially defined by a shoulder 31*s* for receiving a lower end of the piston 32 and the lower seal sleeve 30*b*. The body 31 may have an extension profile 31*e* formed in a pocket surface thereof for each arm 34*a,b* and a retraction profile 31*r* formed in a pocket surface thereof for each arm.

The piston 32 may be tubular, have a longitudinal bore formed therethrough, and may be disposed in the body bore. The piston 32 may have a flow port 32*p* formed through a wall thereof corresponding to each arm 34*a,b*. A nozzle (not shown) may be disposed in each port 32*p* and made from one of the erosion resistant materials discussed above for the catcher 9. The flow sleeve 33 may be tubular, have a longitudinal bore formed therethrough, and be longitudinally connected to the lower seal sleeve 30*b*, such as by a threaded connection. The lower seal sleeve 30*b* may be longitudinally connected to the body 31 by being trapped between the shoulder 31*s* and a top of the catcher housing 25. The upper seal sleeve 30*u* may be longitudinally connected to the body 31, such as by a threaded connection.

Each arm 34*a,b* may be movable between an extended and a retracted position and may initially be disposed in the pocket 31*p* in the retracted position. Each arm 34*a,b* may be pivotally connected to the piston 32, such as by a fastener 35. A pocket surface of the body 31 may serve as a rotational stop for a respective arm 34*a,b*, thereby torsionally connecting the arm 34*a,b* to the body 31 (in both the extended and retracted positions). An upper portion of each arm 34*a,b* may have an extension profile 34*e* formed in an inner surface thereof corresponding to the profile 31*e* and a lower portion of each arm may have a retraction profile 34*r* formed in an inner surface thereof. Each arm 34*a,b* may be held in the retracted position by engagement of the respective retraction profiles 31*r*, 34*r*.

Upward movement of each arm 34*a,b* may disengage the respective retraction profiles 31*r*, 34*r* and engage the respective extension profiles 31*e*, 34*e*, thereby forcing the arm radially outward from the retracted position to the extended position. Each retraction profile 31*r*, 34*r* may be an outwardly (from top to bottom) inclined ramp. Each extension profile 31*e*, 34*e* may have a shoulder. The shoulders may be inclined relative to a radial axis of the body 31 in order to secure each arm 34*a,b* to the body in the extended position so that the arms do not chatter or vibrate during reaming. The inclination of the shoulders may create a radial component of the normal reaction force between each arm 34*a,b* and the body 31, thereby holding each arm 34*a,b* radially inward in the extended position. Additionally, the extension profiles 31*e*, 34*e* may each be circumferentially inclined (not shown) to retain the arms 34*a,b* against a trailing pocket surface of the body 31 to further ensure against chatter or vibration. Alternatively, each arm 34*a,b* may be biased radially inward by a torsion spring (not shown) disposed around the fastener 25.

The underreamer 8 may be fluid operated by drilling fluid 23*d* injected through the drill string 5 being at a high pressure and returns 23*r* flowing up the annulus 24 being at a lower pressure. A lower face 32*b* of the piston 32 may be isolated from an upper face 32*u* thereof by a lower seal 36*b* disposed between an outer surface of the piston 32 and an inner surface of the lower seal sleeve 30*b*. The high pressure may act on the lower face 32*b* via one or more ports 33*p* formed through a wall of the flow sleeve 33 and the low pressure may act on the upper face 32*u* via fluid communication with the pockets 31*p*, thereby creating a net upward actuation force and moving the arms 34*a,b* from the retracted position to the extended position. An upper seal 36*u* may be disposed between the upper seal sleeve 30*u* and an outer surface of the piston 32 to isolate the pockets 31*p*. Various other seals, may be disposed throughout the underreamer 8.

In the retracted position, the piston ports 32*p* may be closed by the flow sleeve 33 and straddled by seals to isolate the ports from the piston bore. In the extended position, the piston ports 32*p* may be exposed to the piston bore, thereby discharging a portion of the drilling fluid 23*d* into the annulus 24 to cool and lubricate the arms 34*a,b* and carry cuttings to the surface 14. This exposure of the piston ports 32*p* may result in a drop in upstream pressure, thereby providing an indication detectable by gauge 19 at the surface 14 that the arms 34*a,b* are extended.

An outer surface of each arm 34*a,b* may form one or more blades 37*a,b* and a stabilizer pad 38 between each of the blades. Cutters 39 may be bonded into respective recesses formed along each blade 37*a,b*. The cutters 39 may be made from a super-hard material, such as polycrystalline diamond compact (PDC), natural or synthetic diamond, or cubic boron nitride. The PDC may be conventional, cellular, or thermally stable (TSP). The cutters 39 may be bonded into the recesses, such as by brazing, welding, soldering, or using an adhesive. Alternatively, the cutters 39 may be pressed or threaded into the recesses. Inserts, such as buttons 40, may be disposed along each pad 38. The buttons 40 may be made from one of the erosion resistant materials discussed above for the catcher 9. The buttons 40 may be brazed, welded, or pressed into recesses formed in the pad 38.

The arms 34*a,b* may be longitudinally aligned and circumferentially spaced around the body 31 and junk slots 31*j* may be formed in an outer surface of the body between the arms. The junk slots 31*j* may extend the length of the pockets 31*p* to maximize cooling and cuttings removal (both from the pilot bit 6*b* and the underreamer 8). The arms 34*a,b* may be concentrically arranged about the body 31 to reduce vibration during reaming. The underreamer 8 may include a third arm (not shown) and each arm may be spaced at one-hundred twenty degree intervals. The arms 34*a,b* may be made from a high strength metal or alloy, such as steel.

The blades 37*a,b* may each be arcuate, such as parabolic, semi-elliptical, semi-oval, or semi-super-elliptical. The arcuate blade shape may include a straight or substantially straight gage portion 37*g* and curved leading 37*f* and trailing 37*t* ends, thereby allowing for more cutters 39 to be disposed at the gage portion and providing a curved actuation surface against the casing shoe 12*s* when retrieving the underreamer 8 from the wellbore 13 should the controller 7 be unable to retract the arms 34*a,b*. The cutters 39 may be disposed on both a leading and trailing surface of each blade 37*a,b* for back-reaming capability. The cutters 39 in the leading 37*f* and trailing 37*t* ends of each blade 37*a,b* may be super-flush with the blade. The gage portion 37*g* may be raised and the gage-cutters flattened and flush with the blade 37*a,b*, thereby ensuring a concentric and full-gage hole.

Alternatively, the cutters 39 may be omitted and the underreamer 8 may be used as a stabilizer instead.

Figure 4A:
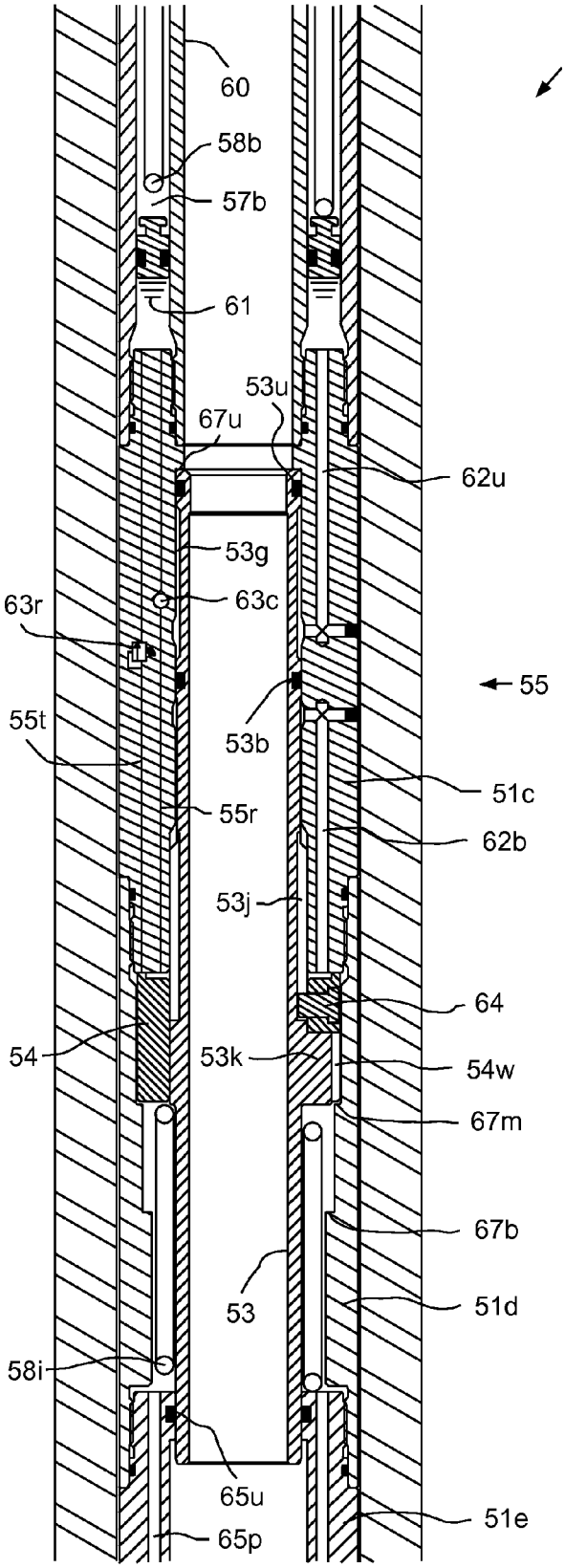
FIGS. 4A-4C illustrate a controller of the BHA in a locked mode.
Figure 4B:
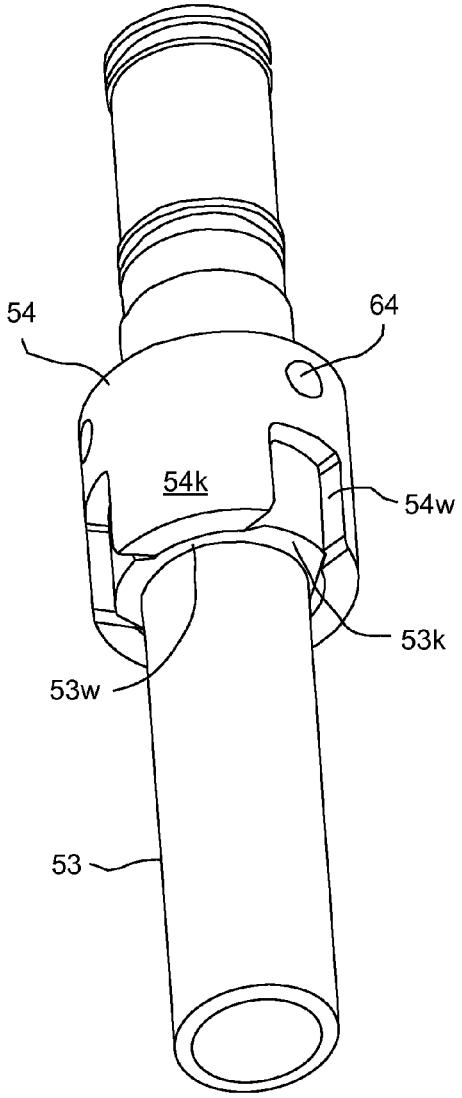
Figure 4C:
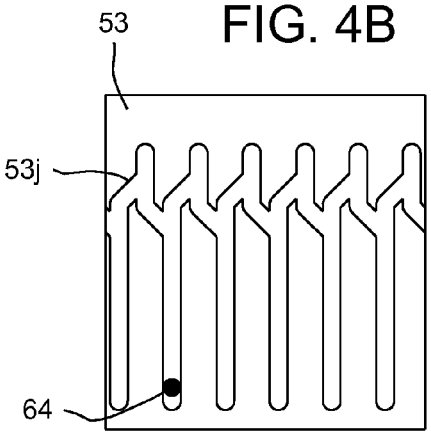

FIGS. 4A-4C illustrate the controller 7 in a locked mode. Referring also to FIGS. 2A and 2B, the controller 7 may include a body 50, a housing 51, a control mandrel 52, a switch mandrel 53, an index sleeve 54, a valve 55, a balance piston 56, a balance chamber 57*b*, a control chamber 57*c*, and one or more biasing members, such as a balance spring 58*b*, an index spring 58*i*, and a return spring 58*r*. The controller 7 may further include seals disposed between various interfaces thereof.

The body 50 may be tubular and have a longitudinal bore formed therethrough. Each longitudinal end of the body 50 may be threaded for longitudinal and torsional connection to other drill string members, such as the underreamer 8 at the lower end thereof and the drill pipe 5*p* (or an adapter thereto) at an upper end thereof. The housing 51 may be tubular and have a longitudinal bore formed therethrough. The housing 51 may be disposed in the body 50 and have one or more sections 51*a-f* connected together, such as by threaded connections. The controller 7 may further include a nut 59 longitudinally connected to the body 50, such as by a threaded connection, and longitudinally connecting the housing 51 to the body by entrapment between the nut and a shoulder 50*s* formed in an inner surface of the body. The nut 59 may be torsionally preloaded to create a torsional coupling via friction between the housing 51 and the body 50.

The balance chamber 57*b* may be formed longitudinally between an upper housing section 51*a* and an upper end of a valve housing section 51*c*. The balance chamber 57*b* may be radially formed between an outer surface of balance sleeve 60 and an inner surface of balance housing section 51*b*. The balance piston 56 may be disposed in the balance chamber 57*b*. Hydraulic fluid 61, such as refined or synthetic oil, may be disposed in a lower portion of the balance chamber 57*b* (below the balance piston 56), an upper portion of the control chamber 57*c*, an index spring chamber, and in passages 55*t,r*, 62*u,b*, 65*p* therebetween. An upper portion of the balance chamber 57*b* may be in fluid communication with a bore of the controller 7 via one or more ports 60*p* formed through a wall of the balance sleeve 60. The balance sleeve 60 may be longitudinally connected to the housing 51, such as by a threaded connection with the valve housing 51*c* at a lower end thereof. An upper end of the balance sleeve 60 may be received in a recess formed in an inner surface of the upper housing section 51*a*. The balance spring 58*b* may be disposed in an upper portion of the balance chamber 57*b* between a lower end of the upper housing section 51*a* and an upper end of the balance piston 56, thereby biasing the balance piston downward toward the valve housing 51*c* and ensuring that the hydraulic fluid 61 is maintained at a pressure slightly greater than drilling fluid pressure in the controller bore.

Figure 8A:
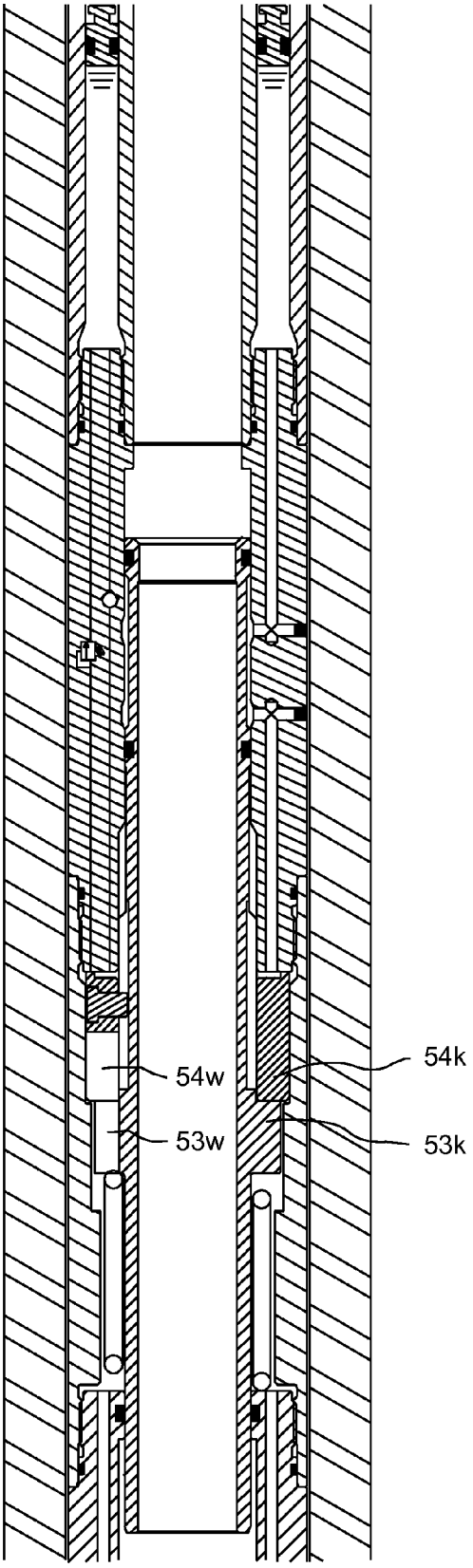
FIGS. 8A-8C illustrate the controller in an unlocked mode.

The control valve 55 may be operable between a closed position (shown) and an open position (FIG. 8A). The control valve 55 may include the valve housing 51*c*, the switch mandrel 53, one or more passages 55*r,t*, formed longitudinally through the valve housing, one or more passage segments 62*u,b* formed partially through the valve housing, and one or more flow control elements, such as a pressure relief valve 63*r* and a check valve 63*c*. The pressure relief valve 63*r* may be disposed in the relief passage 55*t* and may be set at a design pressure of the controller 7 to relieve the control chamber 57*c* to the balance chamber 57*b* should pressure in the control chamber exceed the set pressure to prevent overpressure of the control chamber, such as due to thermal expansion of the hydraulic fluid 61. The check valve 63 may be disposed in the return passage 55*r* and oriented to allow hydraulic fluid flow from the balance chamber 57*b* to the control chamber 57*c* such that the underreamer piston 32 may move to the retracted position regardless of whether the control valve 55 is open or closed.

The switch mandrel 53 may have upper 53*u* and lower 53*b* seal shoulders formed in an outer surface thereof, a bypass groove 53*g* formed between the shoulders, and a seat 66 formed in an inner surface thereof. The switch mandrel 53 may further have a cam profile, such as a J-slot 53*j*, formed in an outer surface thereof and a keyed shoulder 53*k,w* formed in an outer surface thereof adjacent to the J-slot 53*j*. The keyed shoulder 53*k,w* may include alternating keys 53*k* and keyways 53*w* formed around the switch mandrel 53. The index sleeve 54 may have an upper hub portion and a lower keyed portion 54*k,w*. One or more openings may be formed through the hub portion for carrying one or more respective cam followers 64. Each cam follower 64 may extend through the opening and into the J-slot 53*j*, thereby linking the switch mandrel 53 and the index sleeve 54. The index sleeve 54 may be longitudinally connected to the housing 51, such as by entrapment between an upper shoulder 67*m* formed in an inner surface of index housing section 51*d* and a lower end of the valve housing 51*c*, while being free to rotate relative thereto. The keyed portion 54*k,w* may include alternating keys 54*k* and keyways 54*w* formed around the index sleeve 54.

Figure 8B:
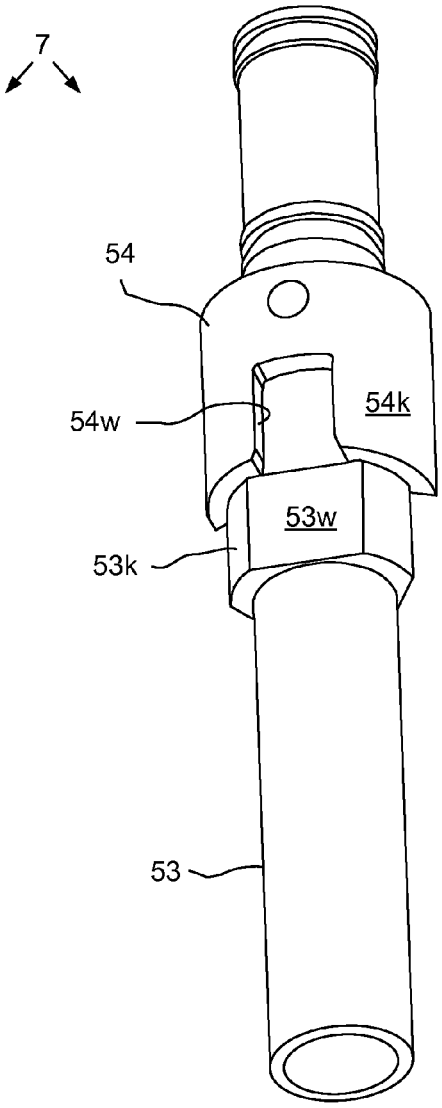

Longitudinal movement of the switch mandrel 53 relative to the housing 51 between an upper position (shown), a lower position (FIG. 6B and in phantom at FIG. 8C), and mid position (FIGS. 6C, 8A and 8B) may rotate the index sleeve 54 due to interaction of the cam follower 64 with the J-slot 53*j*. The lower position may occur when the switch mandrel keys 53*k* engage a lower shoulder 67*b* formed in an inner surface of the index housing section 51*d*. The interaction may rotate the index sleeve 54 between a position where the keyed profiles 53*k,w*, 54*k,w* mate (shown) and a position where the keyed profiles abut (FIGS. 8A and 8B). The index spring 58*i* may be disposed in a chamber formed between the keyed shoulder 53*k,w* and an upper end of a bulkhead housing section 51*e*, thereby biasing the switch mandrel 53 into engagement with a shoulder 67*u* formed in an inner surface of the valve housing 51*c* (keyed profiles mated) or biasing the keys 53*k* of the switch mandrel 53 into engagement with the keys 54*k* of the index sleeve 54. When the keyed profiles 53*k,w*, 54*k,w* are mated, the lower seal shoulder 53*b* may be disposed between adjacent ends of the control passage segments 62*u,b*, thereby closing flow of hydraulic fluid 61 from the control chamber 57*c* to the balance chamber 57*b*. When the keyed profiles 53*k,w*, 54*k,w* are abutted, the bypass groove 53*g* may be disposed between adjacent ends of the control passage segments 62*u,b*, thereby opening flow of hydraulic fluid 61 between the control chamber 57*c* and the balance chamber 57*b*.

A bulkhead housing section 51*e* may have one or more longitudinal passages 65*p* formed therethrough and upper 65*u* and lower 65*b* seal shoulders formed in an inner surface thereof. The upper seal shoulder 65*u* may engage an outer surface of a lower portion of the switch mandrel 53. The lower seal shoulder 65*b* may engage an outer surface of an upper portion of the control mandrel 52. The control chamber 57*c* may be formed longitudinally between the lower seal shoulder 65*b* and the housing shoulder 50*s*. The control chamber 57*c* may be radially formed between an outer surface of control mandrel 52 and inner surfaces of bulkhead housing section 51*e* and a stop housing section 51*f*. The control mandrel 52 may have a piston shoulder 52*p* formed in an outer surface thereof. The piston shoulder 52*p* may be disposed in the control chamber 57*c*. A lower portion of the control chamber 57*c* may be in fluid communication with the controller bore. The return spring 58*r* may be disposed in an upper portion of the control chamber 57*c* between a lower end of the bulkhead section 51*e* and an upper face of the piston shoulder 52*p*, thereby biasing a lower end 52*b* of the control mandrel 52 downward into engagement with an upper end 32*t* of the underreamer piston 32.

In the pilot mode, a drilling operation (e.g., drilling through the casing shoe 12*s*) may be performed without extension of the underreamer 8. Even though force is exerted on the underreamer piston 32 by the drilling fluid 23*d*, the closed control valve 55 may prevent the underreamer piston 32 from extending the arms 34*a,b* due to incompressibility of the hydraulic fluid 61.

Figure 5:
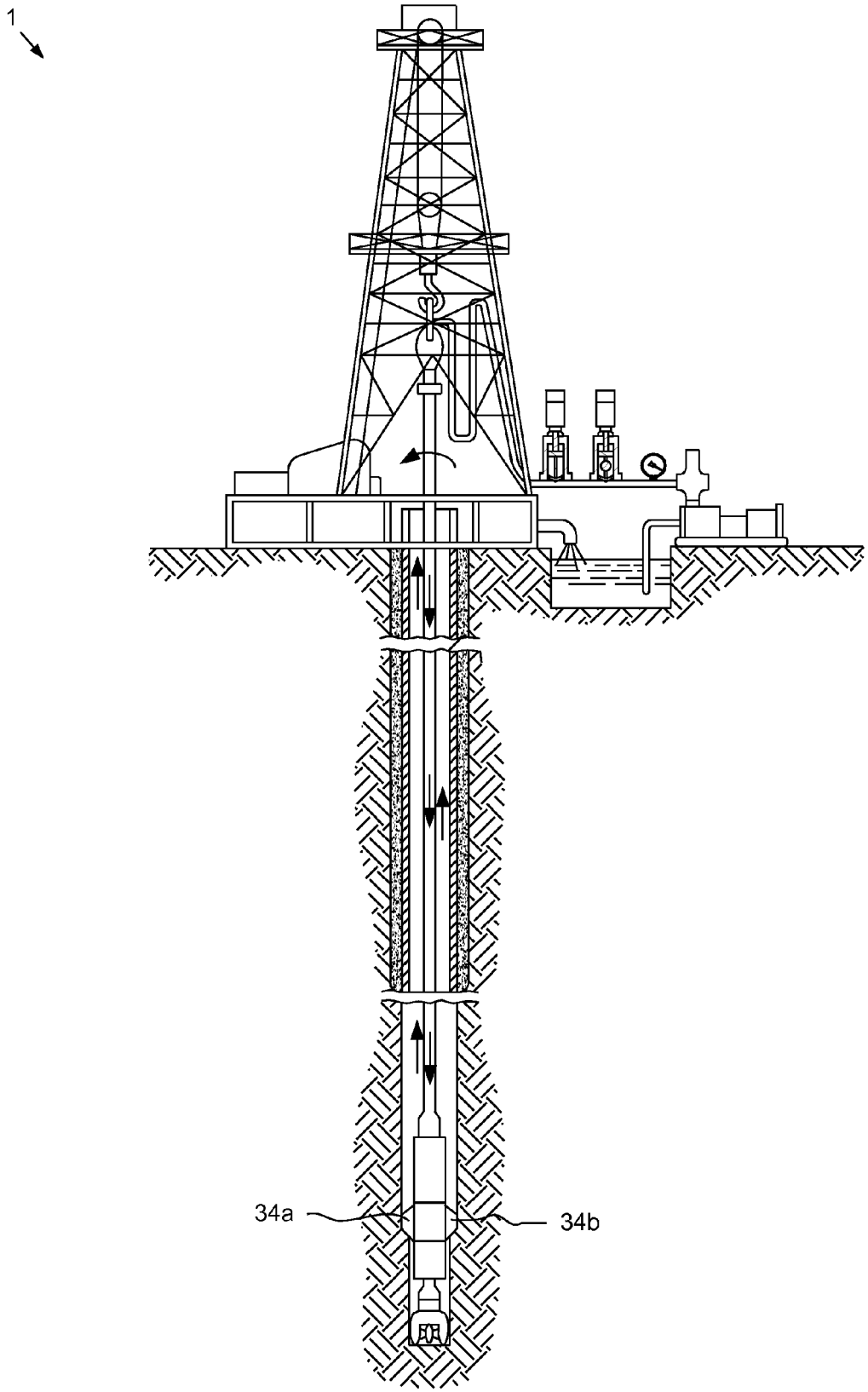
FIG. 5 illustrates the drilling system in a reaming mode.
Figures 6A, 6B, 6C, 6D:
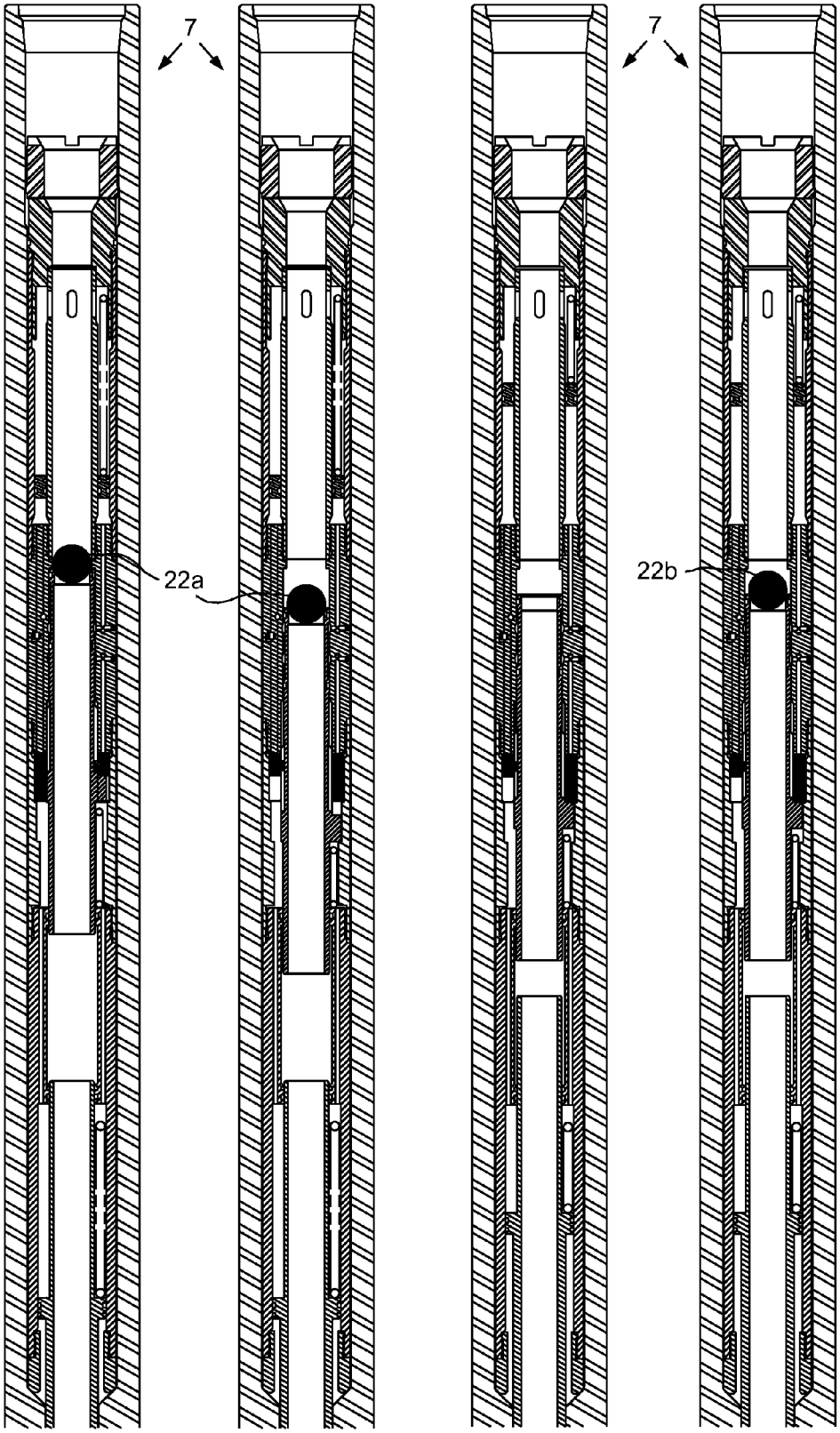
FIGS. 6A-6D illustrate shifting of the controller between modes.
Figure 8C:
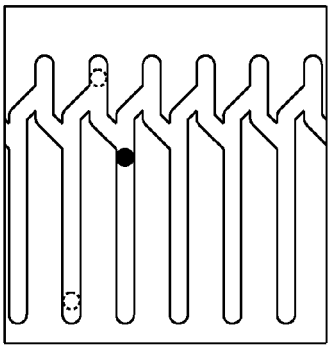

FIG. 5 illustrates the drilling system 1 in a reaming mode. FIGS. 6A-6D illustrate shifting of the controller 7 between modes. FIGS. 7A-7D illustrate shifting of the underreamer 8 between modes. FIGS. 8A-8C illustrate the controller 7 in an unlocked mode. When it is desired to extend the underreamer 8, the first launcher 21*a* may be operated to deploy the first ball 22*a* or the top drive 11 disconnected from the drill pipe 5*p* and the ball inserted into a top of the drill pipe. The first ball 22*a* may be pumped down the drill pipe 5*p* until the seat 66 is reached (FIG. 6A). Drilling fluid 23*d* may continue to be injected by the mud pump 17 into the drill string 5. Due to the obstruction of the controller bore by the seated first ball 22*a*, fluid pressure acting on the first ball 22*a* and upper portion of the switch mandrel 53 increases, thereby driving the switch mandrel to move longitudinally downward relative to the body 51 and index sleeve 54.

Once the switch mandrel 53 engages the lower shoulder 67*b*, pressure may further increase until the squeeze pressure is achieved, thereby pushing the first ball 22*a* through the seat 66, the rest of the controller 7, and the underreamer 8 until the first ball lands onto the cage stop. Pressure in the controller bore may then equalize, thereby allowing the index spring 58*i* to push the switch mandrel longitudinally upward until the switch keys 53*k* engage the index keys 54*k*, thereby opening the control valve 55. The differential between the underreamer bore pressure and the annulus pressure may allow the underreamer piston 32 to extend the arms 34*a,b* and open the piston port 32*p*. The lower formation 16*b* may then be drilled and reamed using the pilot bit 6*b* and the extended underreamer 8.

Once drilling and reaming are complete, a cleaning operation (not shown) may be performed to clear the wellbore 13 of cuttings in preparation for cementing a second string of casing (not shown). The mud pump 17 may be shut off to give the return spring 58*r* a chance to retract the arms 34*a,b*. The second launcher 21*b* may be operated to deploy the second ball 22*b* into the supply line 20 or the top drive 11 again disconnected from the drill pipe 5*p* and the ball inserted into a top of the drill pipe. The switch mandrel 53 may again be driven longitudinally downward relative to the body 51 and index sleeve 54 until engagement with the lower shoulder 67*b* is achieved and pressure increases to deform the second ball 22*b* through the seat 66. If the arms 34*a,b* are jammed in the extended position by cuttings entrained in the pockets 31*p*, the squeeze pressure may augment the retraction force exerted on the arms by the return spring 58*r* to facilitate dislodgement of the arms. The augmented retraction force may be transmitted to the control mandrel piston shoulder 52*p* via the balance sleeve ports 60*p*, the balance piston 56, and the hydraulic fluid 61 and open control valve 55. The second ball 22*b* may then be deformed through the seat 66 into the catcher 9 and the controller 7 may return to the locked position.

Once the arms 34*a,b* have been retracted, the cleaning operation may commence. The cleaning operation may involve rotation of the drill string 5 at a high angular velocity that may otherwise damage the arms 34*a,b* if they are extended. The drill string 5 may be removed from the wellbore during the cleaning operation.

The control module 7 may be used to activate and deactivate the underreamer 8 any number of times subject only to the capacity of the ball catcher 9. This repetitive capability of the controller 7 may impart flexibility to the BHA 6 for other wellbore operations, such as underreaming only a selected portion of the wellbore 13, back-reaming while removing the drill string 5 from the wellbore 13, or performing the cleaning operation periodically during the drilling and reaming operation.

Figure 9A:
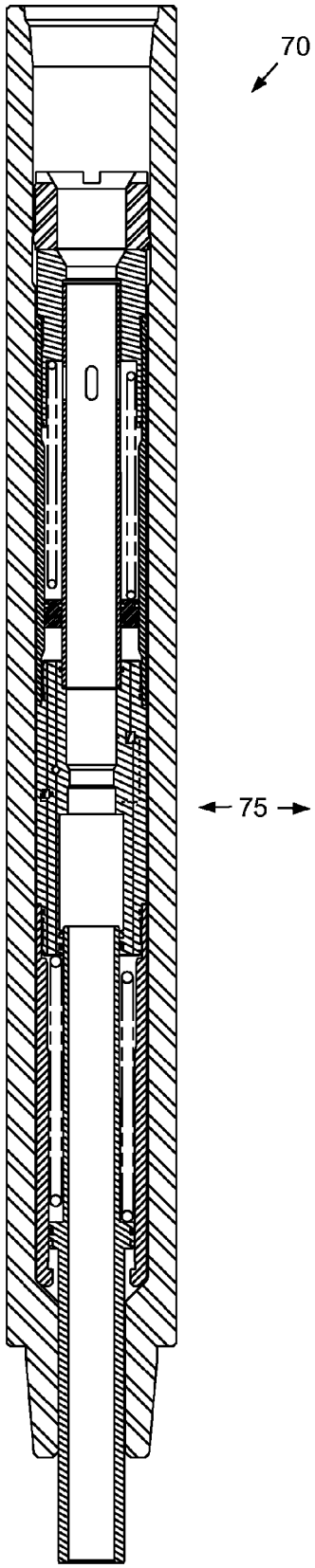
FIGS. 9A and 9B illustrate a second controller for use with the BHA in a locked mode, according to another embodiment of the present disclosure.
Figure 9B:
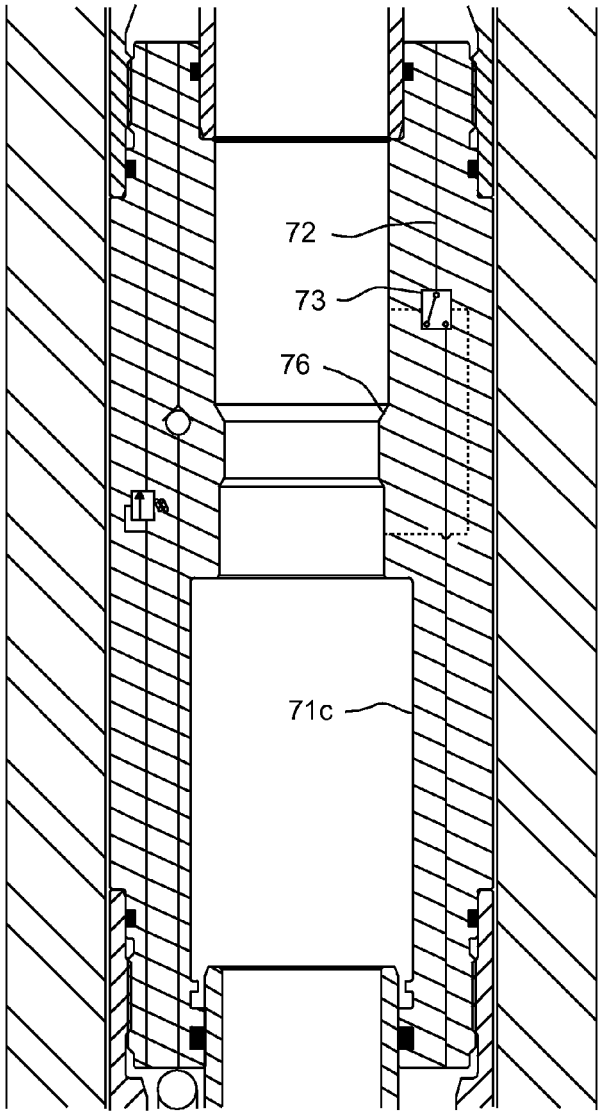
Figures 10A, 10B, 10C:
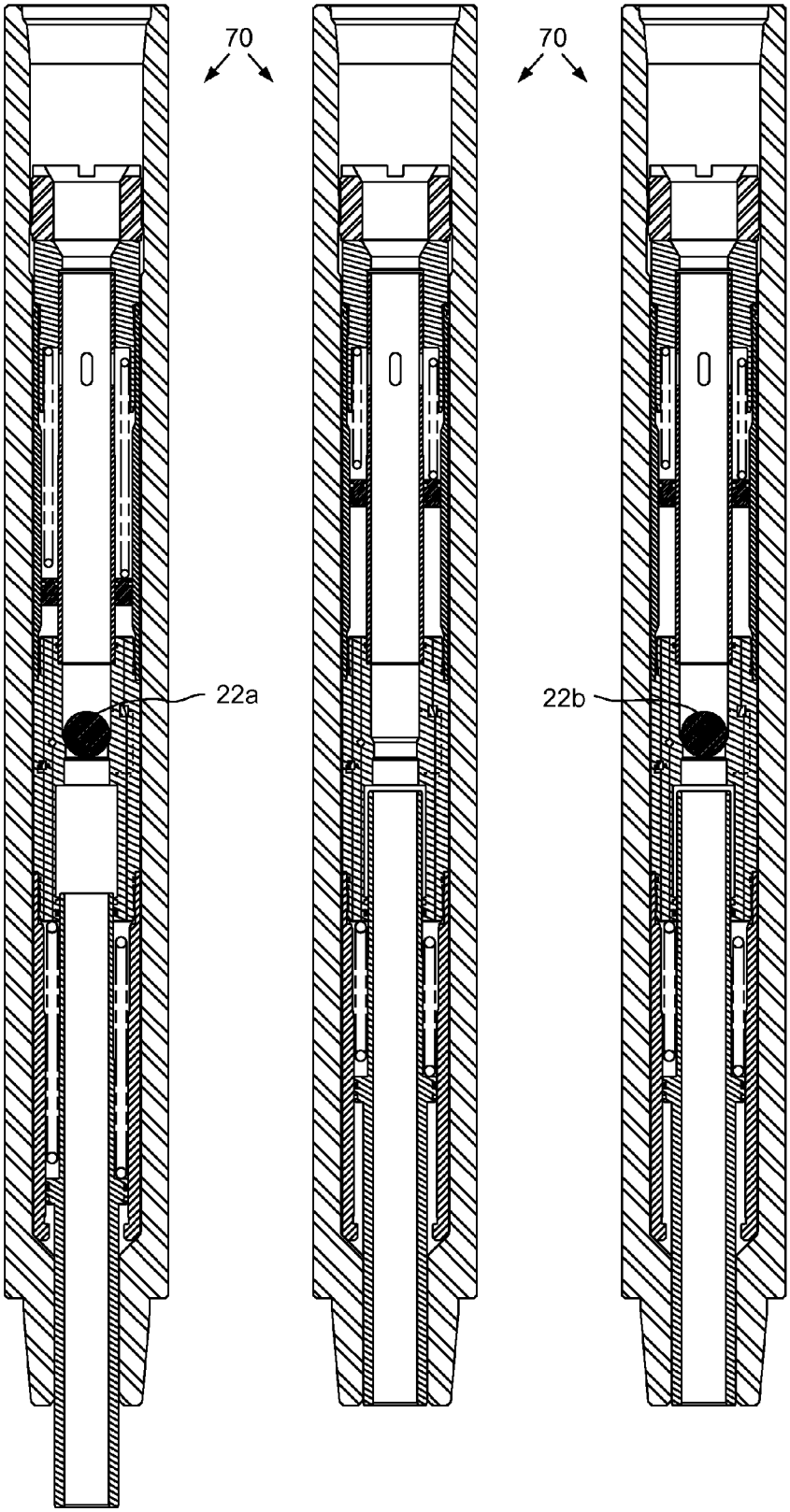
FIGS. 10A-10C illustrate shifting of the second controller between modes.

FIGS. 9A and 9B illustrate a second controller 70 for use with the BHA 6 in a locked mode, according to another embodiment of the present disclosure. FIGS. 10A-10C illustrate shifting of the second controller 70 between modes. The second controller 70 may be used in the BHA 6 instead of the controller 7. The second controller 70 may include a body, a housing, a control mandrel, a valve 75, a balance piston, a balance chamber, a control chamber, and one or more biasing members, such as a balance spring and a return spring. The control valve 75 may include the valve housing, one or more passages 72, formed longitudinally through the valve housing, and one or more flow control elements, such as the pressure relief valve, the check valve, and a toggle valve 73. The second controller 70 may be similar to the controller 7 except that the toggle valve 73 and passage 72 have replaced the passage segments 62*u,b*, the switch mandrel 53, the index sleeve 54, the index housing 51*d*, the index spring 58*i*, and the bulkhead 51*e*. The seat 76 has been moved to the valve housing 71*c*.

The passage 72 may provide fluid communication between the control chamber and the balance chamber. The toggle valve 73 may be disposed in the passage 72 and may be alternately operable between an open position (FIG. 10A) and a closed position (FIG. 9B) in response to a threshold switch pressure differential. The switch differential may be created across the seat 76 by the seated balls 22*a,b*. Once the toggle position has been switched, the toggle valve 73 may remain in that position after the respective ball 22*a,b* has been deformed through the seat 76 and until the next ball has landed in the seat 76.

Figures 11A, 11B, 11C:
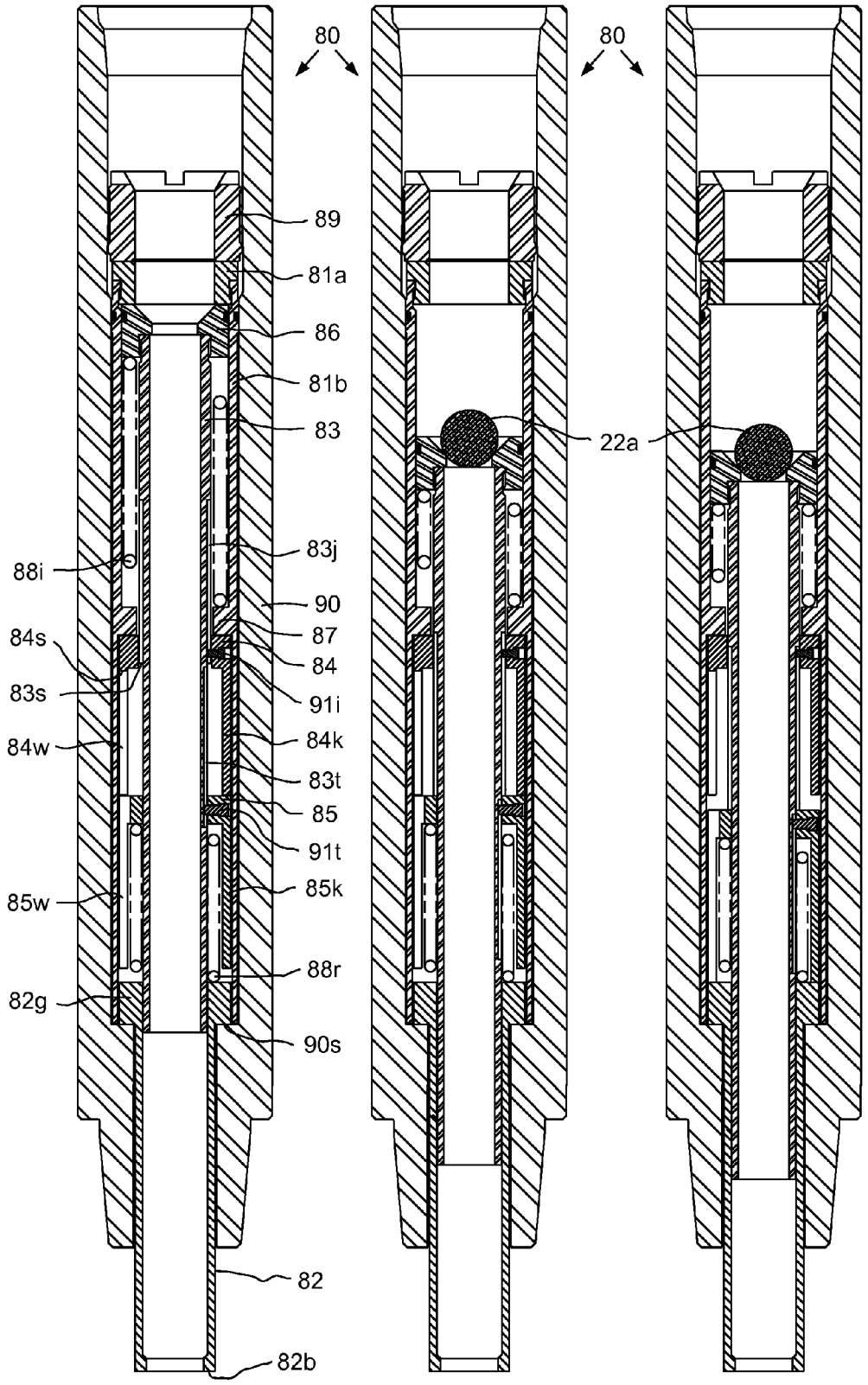

FIG. 11A illustrates a third controller 80 for use with the BHA 6 in a locked mode, according to another embodiment of the present disclosure. FIGS. 11B-12B illustrate shifting of the third controller 80 between modes. The third controller 80 may be used in the BHA 6 instead of the controller 7. The third controller 80 may include a body 90, a housing 81, a control mandrel 82, a switch mandrel 83, an index sleeve 84, a lock sleeve 85, a seat 86, and one or more biasing members, such as an index spring 88*i*, and a return spring 88*r*. The third controller 80 may be similar to the controller 7 except that the third controller is mechanically locked and unlocked instead of hydraulically locked and unlocked.

The body 90 may be tubular and have a longitudinal bore formed therethrough. Each longitudinal end of the body 90 may be threaded for longitudinal and torsional connection to other drill string members, such as the underreamer 8 at the lower end thereof and the drill pipe 5*p* (or an adapter thereto) at an upper end thereof. The housing 81 may be tubular and have a longitudinal bore formed therethrough. The housing 81 may be disposed in the body 90 and have one or more sections 81*a,b* connected together, such as by threaded connections. The controller 80 may further include a nut 89 longitudinally connected to the body 90, such as by a threaded connection, and longitudinally connecting the housing 81 to the body by entrapment between the nut and a shoulder 90*s* formed in an inner surface of the body. The nut 89 may be torsionally preloaded to create a torsional coupling via friction between the housing 81 and the body 90.

The seat 86 may be connected to an upper end of the switch mandrel 83, such as by a threaded connection. An annular space may be formed between the housing 81 and the switch mandrel 83 and a shoulder 87 may be formed in an inner surface of the lower housing section 81*b*. The index spring 88*i* may be disposed in an upper portion of the annular space between a lower end of the seat 86 and an upper face of the shoulder 87, thereby biasing an upper face of the seat 86 into engagement with a lower face of the upper housing section 81*a*.

The switch mandrel 83 may have a cam profile, such as a J-slot 83*j*, formed in an outer surface thereof, a torsion profile, such as a straight slot 83*t*, formed in an outer surface thereof, and a shoulder 83*s* formed between the straight and J-slots. Each of the index sleeve 84 and the lock sleeve 85 may have a respective hub portion and a keyed portion 84*k,w*, 85*k,w* formed in an outer surface thereof. Each keyed portion 85*k,w* may include respective alternating keys 84*k*, 85*k* and keyways 84*w*, 85*w* formed around the index and lock sleeves 84, 85. The index hub portion may be an upper portion having the keyed portion 84*k,w* extending therefrom. The lock hub portion may be an inner portion and the keyed portion 85*k,w* may form the entire outer surface of the lock sleeve 85. One or more openings may be formed through the index hub portion for carrying one or more respective cam followers 911. Each cam follower 911 may extend through the index hub opening and into the J-slot 83*j*, thereby linking the switch mandrel 83 and the index sleeve 84. One or more openings may be formed through the lock hub portion (and one or more of the keys 85*k*) for carrying one or more respective torsion fasteners 91*t*. Each torsion fastener 91*t* may extend through the lock hub opening and into the straight slot 83*t*, thereby torsionally connecting the lock sleeve 85 and the switch mandrel 83 while allowing relative longitudinal movement therebetween, subject to engagement of the shoulder 83*s* with an upper face of the lock sleeve 85.

The index sleeve 84 may be longitudinally connected to the housing 81, such as by entrapment between the shoulder 87 and a stop (not shown), such as by a fastener (not shown) extending through an opening of the lower housing section 81*b* into a groove (not shown) formed in an outer surface of the index hub portion, while being free to rotate relative thereto. The return spring 88*r* may be disposed in a lower portion of the annular space between a lower face of the lock hub and an upper face of a lug 82*g* of the control mandrel 82, thereby biasing a lower end 82*b* of the control mandrel 82 downward into engagement with the upper end of the underreamer piston.

Longitudinal movement of the switch mandrel 83 relative to the housing 81 between an upper position (shown), mid position (FIG. 11B), and a lower position (FIG. 11C) may rotate the index sleeve 84 due to interaction of the cam follower 911 with the J-slot 83*j*. The mid position may occur when the shoulder 83*s* engages the lock sleeve upper face, thereby longitudinally linking the switch mandrel 83 and the lock sleeve 85. The lower position may occur when a lower end of the lock sleeve keys 85*k* engage the upper face of the lug 82*g*.

The interaction may rotate the index sleeve 84 between the unlocked position where the keyed profiles 84*k,w*, 85*k,w* mate (FIG. 12A) and the locked position where the keyed profiles abut (shown). When the keyed profiles 84*k,w*, 85*k,w* are abutted, upward movement of the underreamer piston and control mandrel 82 to extend the arms is prevented by engagement of the lug 82*g* with the lock keys 85*k*, the lock keys with the index keys 84*k*, and the index hub with the housing shoulder 87. When the keyed profiles 84*k,w*, 85*k,w* are mated, the lock sleeve 85 may be free to move upward until an upper face of the lock keys 85*k* engages a shoulder 84*s* formed at an upper end of the index keyways 85*w*, thereby providing sufficient stroke length for extension of the under reamer arms.

Figure 12A:
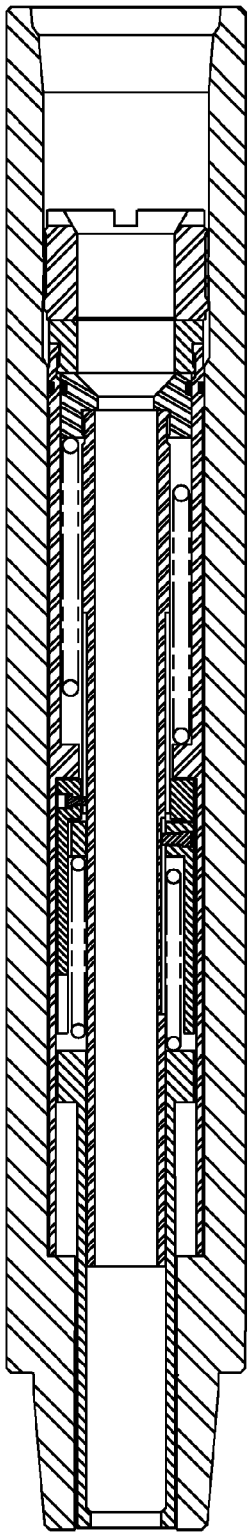
Figure 12B:
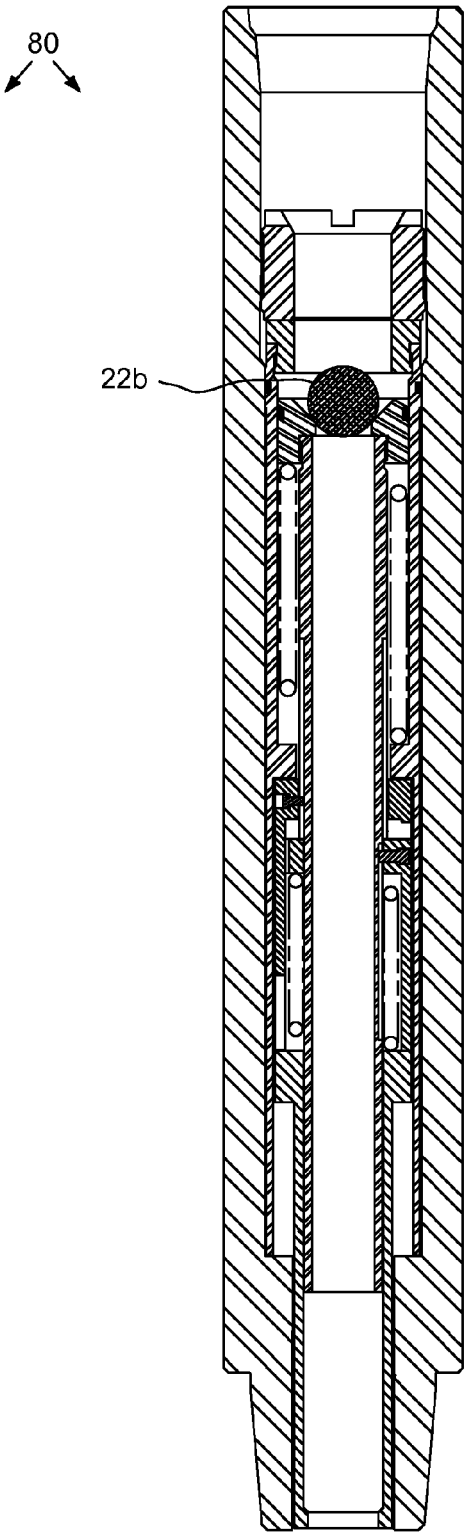

Referring specifically to FIG. 12B, if the underreamer arms are jammed in the extended position by cuttings entrained in the pockets, the squeeze pressure may augment the retraction force exerted on the arms by the return spring 88*r* to facilitate dislodgement of the arms. The augmented retraction force may be transmitted to the control mandrel lug 82*g* by downward movement of the seat 86 and switch mandrel 83 until the shoulder 83*s* engages the upper end of the lock sleeve keys 85*k* and further downward movement until the lower end of the lock sleeve keys engages the lug upper face. The second ball 22*b* may then be deformed through the seat 86 into the catcher and the controller 80 may return to the locked position.

While the foregoing is directed to embodiments of the present disclosure, other and further embodiments of the disclosure may be devised without departing from the basic scope thereof, and the scope of the invention is determined by the claims that follow.

The invention claimed is:

1. A controller for operating a downhole tool, comprising:
a tubular body;
a balance chamber;
a control chamber;
a seat disposed in the body for receiving first and second pump-down plugs, at least a portion of one of the seat and the plugs being radially displaceable to pass through or allow passage of the other of the seat and the plugs at a first threshold pressure differential;
a toggle linked to the seat to alternate between a locked position and an unlocked position in response to seating of the plugs comprising
a switch mandrel having a pair of seal shoulders and a bypass groove formed between the shoulders; and
a valve housing disposed between the chambers having a passage segment in fluid communication with each chamber,
a control mandrel having a piston shoulder disposed in the control chamber and used for engaging a piston of the downhole tool and the control mandrel linked to the toggle:
to be longitudinally movable between a first position and a second position when the toggle is unlocked, and
to be prevented from movement from the first position to the second position when the toggle is locked.

2. The controller of claim 1, wherein:
one of the seal shoulders is disposed between the passage segments in the locked position, and
the bypass groove is disposed between the passage segments in the unlocked position.

3. The controller of claim 2, wherein:
the switch mandrel has one of a cam profile and a follower and a keyed profile, and
the toggle further comprises an index sleeve having the other of the cam profile and a follower and a keyed profile matable or abuttable with the keyed profile of the switch mandrel.

4. The controller of claim 1, wherein the toggle comprises:
a switch mandrel having one of a cam profile and a follower, and
an index sleeve having the other of the cam profile and a follower and a keyed profile.

5. The controller of claim 1,
further comprising a return spring biasing the control mandrel toward the piston,
wherein the control mandrel is also linked to the seat to augment a force applied by the return spring with the first pressure differential.

6. The controller of claim 5, wherein
the linkage between the control mandrel and the seat is hydraulic.

7. A bottom hole assembly, comprising:
the controller of claim 1; and
the downhole tool connected to the controller and comprising:
a second tubular body having a bore therethrough, a pocket formed through a wall thereof, and an extension profile and a retraction profile formed in a surface of the pocket;
an arm:
pivotally connected to the piston and torsionally connected to the second tubular body;
disposed in the pocket in a retracted position;
having an extension profile and a retraction profile;
movable to an extended position where an outer surface of the arm extends outward past an outer surface of the second tubular body; and
the piston:
disposed in the second body bore;
having a bore therethrough;
operable to extend the arm by longitudinally moving the arm in a first direction to disengage the retraction profiles and engage the extension profiles; and
operable to retract the arm by longitudinally moving the arm in a second direction to disengage the extension profiles and engage the retraction profiles.

* * * * *